US007503959B2

(12) United States Patent
Akimoto et al.

(10) Patent No.: US 7,503,959 B2
(45) Date of Patent: Mar. 17, 2009

(54) METHOD FOR MANUFACTURING RHENIUM-CONTAINING ALLOY POWDER, RHENIUM-CONTAINING ALLOY POWDER, AND CONDUCTOR PASTE

(75) Inventors: Yuji Akimoto, Fukuoka (JP); Kazuro Nagashima, Ohnojo (JP); Masayuki Maekawa, Fukuoka (JP); Hidenori Ieda, Dazaifu (JP); Yasuhiro Kamahori, Ogori (JP)

(73) Assignee: Shoei Chemical Inc., Tokyo (JP)

( * ) Notice: Subject to any disclaimer, the term of this patent is extended or adjusted under 35 U.S.C. 154(b) by 183 days.

(21) Appl. No.: 11/581,656

(22) Filed: Oct. 16, 2006

(65) Prior Publication Data

US 2007/0084309 A1 Apr. 19, 2007

(30) Foreign Application Priority Data

Oct. 19, 2005 (JP) ..... 2005-303860
Mar. 15, 2006 (JP) ..... 2006-071018

(51) Int. Cl.
*B22F 9/28* (2006.01)

(52) U.S. Cl. ..... 75/351; 75/369

(58) Field of Classification Search ..... None
See application file for complete search history.

(56) References Cited

U.S. PATENT DOCUMENTS

| | | | | |
|---|---|---|---|---|
| 3,399,981 | A | 9/1968 | Maykuth et al. | |
| 3,503,720 | A | 3/1970 | Peters et al. | |
| 4,604,265 | A * | 8/1986 | Douglas et al. | 423/49 |
| 6,551,377 | B1 * | 4/2003 | Leonhardt | 75/255 |
| 6,652,619 | B2 | 11/2003 | Omori et al. | |
| 2005/0211018 | A1 | 9/2005 | Jurewicz et al. | |
| 2005/0238522 | A1 * | 10/2005 | Leonhardt et al. | 419/28 |

FOREIGN PATENT DOCUMENTS

| | | |
|---|---|---|
| CA | 2 412 291 | 11/2002 |
| JP | 62-1807 | 1/1987 |
| JP | 63-31522 | 6/1988 |
| JP | 5-205969 | 8/1993 |
| JP | 6-172802 | 6/1994 |
| JP | 7-216417 | 8/1995 |
| JP | 2002-20809 | 1/2002 |
| JP | 2002-60877 | 2/2002 |
| JP | 2004-99992 | 4/2004 |
| JP | 2004-319435 | 11/2004 |

OTHER PUBLICATIONS

"Sintering behavior of molybdenum-41 w/o rhenium composite powders versus traditional molybdenum-41 w/o rhenium blended powder", by Moore et al, *International Journal of Powder Metallurgy*, 2003, Abstract Only.

* cited by examiner

*Primary Examiner*—George Wyszomierski
(74) *Attorney, Agent, or Firm*—Flynn, Thiel, Boutell & Tanis, P.C.

(57) ABSTRACT

Metal particles that can be alloyed with rhenium are dispersed as a main component in a gas phase, a rhenium oxide vapor is made to be present around these particles, the rhenium oxide is reduced, and the rhenium precipitated on the surface of the main component metal particles as a result of this reduction is diffused under a high temperature into the main component metal particles, which gives a rhenium-containing alloy powder including the main component metal and rhenium. The powder thus obtained preferably contains 0.01 to 50 wt % rhenium, has an average particle size of 0.01 to 10 μm, and is made into a conductor paste by being uniformly mixed and dispersed in an organic vehicle along with other additives as needed.

9 Claims, No Drawings

METHOD FOR MANUFACTURING RHENIUM-CONTAINING ALLOY POWDER, RHENIUM-CONTAINING ALLOY POWDER, AND CONDUCTOR PASTE

BACKGROUND OF THE INVENTION

1. Field of the Invention

The present invention relates to a method for manufacturing a rhenium-containing alloy powder whose main component is nickel or a metal that can be alloyed with rhenium, such as platinum, palladium, iron, cobalt, ruthenium, or rhodium, and more particularly relates to a method for manufacturing a rhenium-containing alloy powder that can be used suitably in a conductor paste used to form internal conductors in laminated ceramic electronic parts.

2. Description of the Related Art

In the field of electronics, conductor pastes, resistor pastes, and other such thick film pastes are used to manufacture parts such as IC packages, capacitors, resistors, electronic circuits, etc. These pastes are produced by uniformly mixing and dispersing conductive particles of a metal, an alloy, a metal oxide, or the like in an organic vehicle along with a vitreous binder or any other additives that are needed, and the resulting pastes are applied to substrates, and then firing at a high temperature to form conductors or resistors.

Laminated ceramic electronic components, such as laminated capacitors and laminated inductors, or ceramic multilayer substrates are generally manufactured by alternately laminating an unfired (green) ceramic sheet of a dielectric, a magnetic material, or the like, and an internal conductor paste layer, in a plurality of layers of each, and firing all the layers at the same time at a high temperature. It used to be that palladium, silver-palladium, platinum, and other such noble metals were most often used as the internal conductor, but more recently the use of nickel and other such base metal materials has become increasingly popular because of the need to conserve resources and to reduce the delamination and cracking caused by oxidation expansion during the firing of palladium or silver-palladium, and so forth.

There is a trend toward increasing the number of laminations with these laminated parts and multilayer substrates, to the point that laminated capacitors, for instance, are beginning to be manufactured with hundreds of layers of lamination. This has made it necessary to reduce the film thickness of the ceramic layers, and in turn to further reduce the film thickness of the internal conductor layer. For example, if the thickness of a ceramic layer is about 3 μm, unless the internal conductor film thickness is 1 μm or less, and preferably about 0.5 μm, the middle part of the laminate will end up being too thick, and this can lead to structural defects and diminished reliability.

However, when ordinary nickel particles are used for an internal conductor paste, excessive sintering of the nickel particles during firing can cause them to clump together or cause abnormal particle growth, so not only does the internal conductor become a discontinuous film, which can lead to higher resistance, or to circuit disconnection, but another problem is that the conductor becomes thicker, so there has been a limit to how thin a film could be made. Specifically, when nickel particles are fired in a non-oxidizing atmosphere, such as an inert atmosphere or a reducing atmosphere, in order to prevent oxidation, their sintering begins early, and even single crystal particles with relatively low activity begin to sinter and shrink at a low temperature of 400° C. or lower.

Meanwhile, the temperature at which a ceramic layer starts to sinter is generally much higher than this. For example, the temperature is approximately 1200° C. with barium titanate, and when a ceramic green sheet of this and a nickel internal conductor paste layer are alternately laminated in a plurality of layers of each, and all these layers are fired at the same time at a high temperature, the ceramic layers do not shrink together with the nickel films, so the nickel films are pulled in the planar direction. Consequently, it is presumed that small voids produced in the nickel films by sintering at a relatively low temperature expand into large holes as the sintering proceeds at higher temperatures, or that this is accompanied by growth of the film in the thickness direction.

Therefore, to reduce the thickness of the nickel internal conductor layers, it seems to be necessary to make the nickel particles finer and give them better dispersibility, so that as few voids as possible are created during firing, and to match the sintering shrinkage behavior with that of the ceramic layers. Also, even when the films are formed thicker, this mismatching of the sintering shrinkage behavior between the conductor layers and the ceramic layers causes delamination or cracking and other such structural defects, and is therefore a problem in that it lowers the yield and the reliability of the product.

Various attempts have been made in the past to suppress the sintering of conductor layers up to the sintering commencement temperature of the ceramic layers. For example, the sintering commencement of conductor layers can be apparently delayed to about 800° C. by adding ceramic particles with the same composition as that used in the ceramic layer to the conductor paste. However, since the sintering of the metal particles themselves in the conductor layer is not being suppressed, when the material is fired at a high temperature of about 1300° C., the conductor layer still loses its continuity and conductivity. Also, there is no effect unless these additives are used in a large quantity, so other problems such as higher resistance, etc., arise.

Patent Document 1, listed below, states that the sintering commencement temperature of a conductor paste can be raised by using an alloy powder composed of nickel and at least one element selected from among vanadium, chromium, zirconium, niobium, molybdenum, tantalum, and tungsten as the metal powder used for the conductor paste used in forming the internal conductor of a laminated ceramic capacitor. Nevertheless, the elements disclosed in Patent Document 1 are all baser metals than nickel, so even when the firing is performed under conditions under which nickel will not be oxidized, these other metals often ended up being selectively oxidized. As a result, there is the danger that they will react with the surrounding ceramic and adversely affect the electric characteristics of the laminated ceramic electronic part.

In view of this, various studies have been conducted to find the ideal metal elements for alloying with nickel, and attention has recently been directed to rhenium. Rhenium is one of high-melting point metals, and it is expected to be very effective at suppressing sintering when used for the formation of an internal conductor used in laminated ceramic electronic parts. For instance, Patent Document 2, listed below, discloses a composite powder in which nickel is coated with rhenium.

However, while rhenium is more noble than nickel, it cannot really be considered to have low chemical reactivity, and rhenium oxide in particular sublimates at a low temperature of just a few hundred degrees centigrade. This means that when a rhenium powder or a rhenium-coated metal powder is used to form conductors for electronic parts, the material must be handled with the greatest of care to avoid the oxidation of the rhenium during firing and so on. Alloying nickel and rhenium is thought to be advantageous in terms of suppressing this reactivity of rhenium.

Still, with the alloy powder manufacturing methods known up to now, it was difficult to stably produce alloy powders that were homogeneous and had a small particle size, and alloy powders of nickel and rhenium were particularly difficult to manufacture.

For instance, Patent Document 1 discusses the manufacture of an alloy powder by heating together chlorides of metal elements contained in the alloy powder, evaporating them and mixing these vapors, and then subjecting them to hydrogen reduction, but with a CVD (Chemical Vapor Deposition) method such as this, the particles of the various metal elements typically are not alloyed, and instead are produced individually.

Also, it is possible that PVD (Physical Vapor Deposition) could also be utilized if the vapor pressures of the metals constituting the alloy were close enough to each other, but when the vapor pressures are greatly different, as is the case with nickel and rhenium, it is exceedingly difficult to control the alloying ratio, so a homogeneous nickel-rhenium alloy power cannot be obtained consistently. Because of this, with a powder obtained by a conventional vapor deposition method, the particles of the various metal elements typically are not alloyed, and instead are produced individually, so the product ends up being either a mixed powder in which particles of the various metal elements are both present, or, even if the elements can be successfully alloyed, the powder ends up being one with considerable variance, in which the particle form and average size, the alloying ratio, and so forth are not uniform. When a powder such as this is used to form a conductor for a laminated ceramic electronic part, this lack of uniformity precludes obtaining good electric characteristics.

There is also known a wet reduction method (co-precipitation method) in which aqueous solutions of the metal ions constituting the alloy particles are mixed, and this mixture is then reduced to precipitate a powder, but most of the powder that is precipitated ends up as an agglomeration of fine particles of the various metal elements, and a separate heat treatment is necessary to alloy these agglomerated fine particles. Since the agglomeration further proceeds during this heat treatment, it becomes even more difficult to obtain a fine powder with a uniform particle size. Furthermore, if the surface of the unalloyed agglomerated powder is oxidized into rhenium oxide during heating, since rhenium oxide sublimates even at relatively low temperatures, this process is unsuited to the production of an alloy containing rhenium.

Other known methods include atomization and pulverization, but there is a limit to the size of the powder obtained with either of these, and it has been extremely difficult to obtain a powder with an average particle size on the order of 0.05 to 1.0 μm, which is needed nowadays to form internal conductors for laminated ceramic electronic parts.

Spray pyrolysis is another known method for manufacturing an alloy powder. As discussed in Patent Documents 3, 4, and 5, listed below, and elsewhere, spray pyrolysis is a process in which a solution containing one or more kinds of metal oxide, or a suspension in which these have been dispersed, is sprayed to form fine droplets, these droplets are heated to a temperature higher than the pyrolysis temperature of the metal compounds, and preferably a high temperature that is close to or above the melting point of these metals, and the metal compounds are pyrolyzed, thereby precipitating a metal or alloy powder. This method yields a high-density, highly dispersible, truly spherical metal powder or alloy powder that is either highly crystalline or in the form of single crystals. Unlike a wet reduction process, this method does not require any solid-liquid separation, so manufacture is easier, and since the method involves no additives or solvents that would effect purity, it has the advantage of yielding a high-purity powder containing no impurities. Furthermore, the particle size is easy to control, and the composition of the produced particles basically matches well the composition of the starting metal compounds in the solution, so another advantage is that the composition is easy to control.

However, when a nickel-rhenium alloy powder is manufactured with this method, a solution containing nickel and rhenium is sprayed and pyrolyzed, but because of the above-mentioned characteristics of rhenium, heating causes just the rhenium component to vaporize and separate, so a powder of nickel alone is all that is actually obtained by pyrolysis. This means that a nickel-rhenium alloy powder cannot be obtained by a conventional spray pyrolysis process.

The manufacturing methods discussed in Patent Documents 6 and 7 listed below, are also known. With the methods described in these publications, at least one kind of thermally decomposable metal compound powder is supplied by carrier gas to a reaction vessel, the metal compound powder is dispersed in the gas phase at a concentration of 10 g/L or less, and in this state the powder is heated at a temperature higher than the decomposition temperature and not lower than (Tm−200)° C., where Tm° C. is the melting point of the metal, in order to produce metal powder. This method makes it easy to obtain a metal powder that has spherical particles, good crystallinity, and high dispersibility. It is also possible to obtain a single crystal metal powder by heating the raw material compound powder at a temperature of not lower than the melting point of the metal. Since no additives or solvents that would effect purity are used, a high-purity powder containing no impurities is obtained. Furthermore, a metal powder of uniform particle size can be obtained by controlling the particle size of the raw material powder, so the adjustment of particle size is also easy. There is therefore no need for a classification step, and an extremely fine powder with a narrow particle size distribution that is suited to a thick film paste can be obtained. Also, since the raw material are not put in the form of a solution or suspension, energy loss through evaporation of the solvent is lower than with an ordinary spray pyrolysis method, and the powder can be manufactured more simply and less expensively. Moreover, there is no problem with agglomeration of droplets, and the powder can be dispersed in the gas phase at a relatively high concentration, so efficiency is higher.

Nevertheless, when a nickel-rhenium alloy powder is manufactured with this method, a thermally decomposable metal compound powder containing nickel and rhenium must be prepared as the raw material powder. Chlorides, nitrates, carbonyls and other such compounds with a relatively simple structure, and so forth can be used as thermally decomposable raw material powders, but because these compounds have a low pyrolysis temperature, it is difficult to control their alloying quantitatively. An organic acid salt with a relatively high decomposition temperature, such as a formate, acetate, or oxalate, is thought to be good for improving this control, but when it comes to rhenium, synthesis is extremely difficult, and this complicates manufacture.

As discussed above, with the methods known in the past for manufacturing an alloy powder, if an attempt was made to manufacture an alloy powder containing rhenium, it was difficult to obtain an alloy powder that had a small average particle size, excellent dispersibility, and a uniform alloying ratio.

Patent Document 1: Japanese Patent Publication 2002-60877A

Patent Document 2: Japanese Patent Publication 2004-319435A

Patent Document 3: Japanese Patent Publication 62-1807A

Patent Document 4: Japanese Patent Publication 6-172802A

Patent Document 5: Japanese Patent Publication 7-216417A

Patent Document 6: Japanese Patent Publication 2002-20809A

Patent Document 7: Japanese Patent Publication 2004-99992A

SUMMARY OF THE INVENTION

It is an object of the present invention to provide a novel and superior method for manufacturing a rhenium-containing alloy powder which makes it possible to easily and stably obtain a nickel-rhenium alloy powder, as well as other rhenium-containing alloy powders whose main component is a metal that can be alloyed with rhenium, such as platinum, palladium, iron, cobalt, ruthenium, rhodium or the like, which were very difficult to obtain in the prior manufacturing art. More particularly, it is an object to provide a manufacturing method with which a rhenium-containing alloy powder that contains rhenium and a main component metal that can be alloyed with rhenium, such as nickel, and preferably has an average particle size of 0.01 to 10 μm, and has a homogeneous composition, can be obtained simply and stably. Furthermore, it is an object to provide a rhenium-containing alloy powder obtained by the manufacturing method, and a conductor paste containing the rhenium-containing alloy powder.

To solve the above problems, the present invention is constituted as follows.

(1) A method for manufacturing a rhenium-containing alloy powder, containing rhenium and a main component metal other than rhenium, comprising the steps of:

dispersing particles of the main component metal in a gas phase and causing a vapor of rhenium oxide to be present around the particles;

reducing the rhenium oxide; and producing the rhenium-containing alloy powder by diffusing the rhenium precipitated on a surface of the main component metal particles by the reduction, into the main component metal particles under a high temperature.

(2) The manufacturing method according to (1) above, wherein, in the step of diffusing the rhenium into the main component metal particles, the main component metal particles are at least partially molten particles.

(3) The manufacturing method according to (1) or (2) above, wherein at least the step of producing the rhenium-containing alloy powder is conducted in a non-oxidizing atmosphere.

(4) The manufacturing method according to any of (1) to (3) above, wherein a step of producing the main component metal particles is conducted prior to the step of dispersing the main component metal particles.

(5) The manufacturing method according to (4) above, wherein the main component metal particles are produced by a manufacturing method selected from among physical vapor deposition, chemical vapor deposition, spray pyrolysis, and a method in which a thermally decomposable main component metal compound powder is pyrolyzed in a gas phase.

(6) The manufacturing method according to any of (1) to (3) above, wherein a raw material solution obtained by dissolving the main component metal and rhenium is made into droplets, and then heated, thereby dispersing the main component metal particles in the gas phase and causing rhenium oxide vapor to be present around the particles.

(7) The manufacturing method according to any of (1) to (6), wherein an average particle size of the rhenium-containing alloy powder is from 0.01 to 10 μm.

(8) The manufacturing method according to any of (1) to (7), wherein a content of rhenium in the rhenium-containing alloy powder is from 0.01 to 50 wt %.

(9) The manufacturing method according to any of (1) to (8) above, wherein the main component metal includes at least one metal selected from the group consisting of nickel, platinum, palladium, iron, cobalt, ruthenium, and rhodium.

(10) The manufacturing method according to (9) above, wherein the main component metal includes nickel.

(11) A rhenium-containing alloy powder, manufactured by the manufacturing method according to any of (1) to (10) above.

(12) A conductor paste, containing the rhenium-containing alloy powder according to (11) above.

With the manufacturing method of the present invention, the average particle size and dispersibility of the resulting rhenium-containing alloy powder are dependent on the average particle size and dispersibility of the main component metal particles of nickel or the like that serve as the raw material. Consequently, if a suitable material is used for the main component metal particles, a rhenium-containing alloy powder with a small and uniform particle size and good dispersibility can be obtained.

Also, with the manufacturing method of the present invention, the rhenium precipitated on the surface of the main component metal particles is completely alloyed with the main component metal particles before being oxidized again, so a uniform rhenium-containing alloy powder in terms of alloying ratio and so forth can be obtained stably.

Also, since the manufacturing method of the present invention involves the use of vapor phase rhenium oxide and main component metal particles such as metallic nickel particles, there is no precipitation of rhenium powder by itself. Therefore, it is easy to control the alloying ratio, and a rhenium-containing alloy powder, such as a nickel-rhenium alloy powder, with a uniform composition can be obtained.

Also, when the main component metal particles used to manufacture the rhenium-containing alloy powder are produced by CVD, PVD, or another vapor deposition method, or the spray pyrolysis method discussed in Patent Document 3 and elsewhere, or a method in which a thermally decomposable main component metal compound powder is pyrolyzed in the gas phase as discussed in Patent Document 6 and elsewhere, production efficiency is raised because the rhenium-containing alloy powder is manufactured continuously by introducing the main component metal particles immediately after their production into a reaction vessel to which a rhenium oxide vapor is supplied.

Because the above-mentioned rhenium-containing alloy powder is obtained as fine particles with uniform composition and particle size, they can be used to advantage in conductor pastes used for forming internal conductors for laminated ceramic electronic parts, as well as in conductor pastes used in various other applications. In particular, when a nickel-rhenium alloy powder is used as a conductor paste for forming an internal conductor for laminated ceramic electronic parts, the alloying with rhenium effectively suppresses the sintering of the nickel particles, and their sintering shrinkage behavior can be made to approximate that of the ceramic layers, so it is possible to obtain a conductor paste which allows the formation of extremely thin internal electrode films without causing structural defects or electrode discontinuity due to the mismatching of the sintering shrinkage behavior between the conductor layers and the ceramic layers. With the present invention, when a nickel-rhenium alloy powder is manufactured, a nickel-rhenium alloy powder having a particularly outstanding effect in terms of application to ceramic laminated electronic parts and so forth will be obtained, but the present invention is not limited to this, and a rhenium-containing alloy powder having a superior effect that could not be obtained with prior art known in the past can be obtained even when manufacturing an alloy powder in which rhenium is combined with a metal other than nickel as the main component metal.

Also, because the rhenium-containing alloy powder obtained with the manufacturing method of the present invention is superior in its oxidation resistance, the above-mentioned conductor paste will not oxidize during firing and adversely affect characteristics such as electroconductivity.

DETAILED DESCRIPTION OF THE PREFERRED EMBODIMENTS

With the present invention, the phrase "rhenium-containing alloy powder" refers to an alloy powder of a main component metal and metallic rhenium, and the main component metal includes at least one or more metals of nickel and other metals (e.g., platinum, palladium, iron, cobalt, ruthenium, rhodium, etc.) that can be alloyed with rhenium. In particular, when the rhenium-containing alloy powder of the present invention is used to form an internal conductor for laminated ceramic electronic parts, the above-mentioned main component metal is preferably metallic nickel. As will be described below, this main component may also include a third component.

The amount in which the rhenium is contained is preferably between 0.01 and 50 wt %, and even more preferably between 1.0 and 10 wt %, with respect to the total amount of alloy powder. If the content is under 0.01 wt %, the benefit of alloying becomes slight. For instance, the effect of suppressing sintering becomes small when the powder is used for an internal conductor in laminated ceramic electronic parts. If the content is over 50 wt %, however, the rhenium phase will tend to precipitate, making it more difficult to obtain a uniform alloy powder.

The present invention does not exclude a case in which the rhenium-containing alloy powder includes a third component besides metallic rhenium and the above-mentioned metal that can be alloyed with rhenium, and if necessary, gold, silver, copper, tungsten, niobium, molybdenum, vanadium, chromium, zirconium, tantalum, or another such metal element may be included. Furthermore, when the main component metal includes a metal with high catalytic activity, such as nickel or platinum, an element that will reduce the catalytic activity can also be contained as the third component in a suitable proportion. For example, when the main component metal includes nickel, a light element, such as sulfur, oxygen, phosphorus or silicon which reduces the catalytic activity of nickel may be contained in a proper proportion. These third components may be included in the main component metal particles as a raw material to be alloyed with rhenium. In the following discussion, particles obtained by adding the third component ahead of time to the metal particles of the main component will also be referred to as "main component metal particles." For example, particles obtained by adding the third component ahead of time to metallic nickel particles will also be called metallic nickel particles. Also, the third component can be added to the rhenium-containing alloy powder in the course of manufacturing a rhenium-containing alloy powder by a suitable method such as having a vapor of the third component be present in the rhenium oxide vapor. This third component may be a single component or a combination of two or more.

The average particle size of the rhenium-containing alloy powder of the present invention can be suitably determined according to the intended application, but preferably the average particle size is between 0.01 and 10 μm. In particular, with a nickel-rhenium alloy powder that is favorable for forming internal conductors for highly laminated ceramic electronic parts, the average particle size thereof is preferably between 0.05 and 1.0 μm. Below this range, the powder will tend to agglomerate, or its activity will be too high and sintering will occur sooner. Above this range, however, it will be difficult to use the powder to form internal conductors for highly laminated ceramic electronic parts.

The rhenium-containing alloy powder manufactured by the manufacturing method of the present invention can be used appropriately in conductor pastes for forming internal conductors for highly laminated ceramic electronic parts, and in conductor pastes that are fired simultaneously with the ceramic layers, such as conductor pastes used for via holes, as well as in other conductor paste applications, such as for forming various kinds of electrodes, for forming circuit conductors, or for forming connection-use conductors, or in resistor pastes and so forth.

<Manufacturing Method>

(1) Nickel-Rhenium Alloy Powder

A case in which solid-state metallic nickel particles are used as the nickel raw material will now be described.

In this example, the metallic nickel particles are dispersed in a gas phase while still in the solid-state. Here, the metallic nickel particles may be particles that have been manufactured in advance, or metallic nickel particles may be produced prior to the above-mentioned dispersion, and continuously alloyed.

When metallic nickel particles are prepared ahead of time, there are no particular restrictions on the method by which they are manufactured, but examples include known methods such as atomization, wet reduction, PVD, CVD, and spray pyrolysis, or a method in which a thermally decomposable nickel compound is pyrolyzed in the gas phase as discussed in Patent Document 6, et al.

When an alloy powder is manufactured continuously from the production of metallic nickel particles, the metallic nickel particles are preferably produced by PVD, CVD, the spray pyrolysis method discussed in Patent Document 3 and elsewhere, or the method discussed in Patent Document 6 and elsewhere. All of these manufacturing methods produce metallic nickel particles in the gas phase, so the metallic nickel particles thus produced can be continuously and directly moved on to the step discussed below along with a carrier gas, which boosts production efficiency. In particular, metallic nickel particles manufactured by the spray pyrolysis method discussed in Patent Document 3 and elsewhere, or by the method discussed in Patent Document 6 and elsewhere, can be used favorably for forming conductors for laminated ceramic electronic parts because the particles are spherical and small in size, have good crystallinity, and have good dispersibility.

Meanwhile, a vapor of rhenium oxide is preferably used as the rhenium raw material in the present invention. In particular, rhenium heptoxide ($Re_2O_7$) can be used to advantage in the manufacturing method of the present invention because it contains no harmful substances and it readily sublimates into a vapor at relatively low temperatures.

A precursor of rhenium oxide may also be used. For instance, when an aqueous solution obtained by dissolving metallic rhenium in a nitric acid aqueous solution (hereinafter referred to simply as a "rhenium nitric acid solution") is used, rhenium oxide may be produced by generating fine droplets by spraying this solution from an ultrasonic type or twin-fluid nozzle type atomizer or other such atomizer, and then heating this in a reaction vessel described below. Also, if the solution is pumped into the system with a metering pump, quantitative accuracy will be better and the alloying ratio will be more stable.

With CVD and other such methods in which nickel chloride is used as the raw material for manufacturing metallic nickel particles, rhenium chloride or the like can also be used as a precursor.

The vapor of rhenium oxide is supplied to the gas phase before, during, or after the dispersion of the above-mentioned metallic nickel particles in the gas phase. The amount in which the rhenium oxide vapor is supplied here is suitably controlled as dictated by the desired alloying ratio.

With the present invention, a rhenium oxide vapor may be uniformly present around the metallic nickel particles at the point when the rhenium oxide is reduced (discussed below), and the point in time when the metallic nickel particles and the rhenium oxide vapor are dispersed/supplied to the gas phase is not important. Specifically, an example will be given here where a rhenium oxide vapor is supplied to a gas phase in which metallic nickel particles have been dispersed, but the present invention is not limited to this, and may instead be such that the metallic nickel particles are dispersed in a gas phase that contains the rhenium oxide vapor, or such that the metallic nickel particles and the rhenium oxide vapor are dispersed/supplied to the gas phase at the same time.

Next, the rhenium oxide vapor is subjected to a reduction reaction in a state in which the rhenium oxide vapor is uniformly present around the metallic nickel particles dispersed in the gas phase. Accordingly, when this reduction reaction is conducted, a reducing agent is preferably present in the gas phase. Reducing agents that can be used favorably include hydrogen gas, carbon monoxide, and other such reductive gases, and carbon, a hydrocarbon, an alcohol, and the like. This reduction reaction causes the rhenium oxide vapor to be reduced and metallic rhenium to precipitate on the surface of the metallic nickel particles dispersed in the gas phase.

Then, the metallic nickel particles on whose surface the metallic rhenium is precipitated in the above reduction step are heated while still dispersed in the gas phase, so that the rhenium diffuses into the metallic nickel particles and the nickel and rhenium are completely alloyed. After it has been completely alloyed, the metallic rhenium will not be oxidized by itself, so a chemically stable alloy powder is obtained. Everything from the reduction step up to the alloying step is preferably carried out in a non-oxidizing atmosphere so that the precipitated rhenium will not be oxidized and sublimate before being alloyed. Also, if the metallic nickel particles have been sufficiently heated by the time they go to the alloying step, and the precipitated rhenium is in a heated state enough to be able to diffuse completely into the metallic nickel particles, then special heating for alloying is not necessarily required. The above alloying step is conducted at a high temperature of not lower than 500° C., preferably not lower than 800° C., and more preferably not lower than the melting point of the metal particles.

The reduction step and the alloying step do not have to be independent in time. For instance, in the reduction step and the alloying step, the entire amount of rhenium prepared ahead of time may be precipitated on the surface of the metallic nickel particles, and then heated to alloy the nickel and rhenium, but preferably the metallic nickel particles are at least partially in a molten state in the reduction step, and, while precipitating rhenium, the precipitated rhenium is sequentially alloyed by being diffused into the metallic nickel particles. This further suppresses the oxidation and sublimation of the rhenium. In this case, the reduction step and the alloying step are performed simultaneously or repeatedly.

The above was a description of a case in which solid-state metallic nickel particles were used as the nickel raw material, but the present invention is not limited to this, and metallic nickel particles that are at least partially molten may be used. For example, solid-state metallic nickel particles may be heated ahead of time and put in a totally or partially molten state while still retaining their state of being dispersed as particles, and then rhenium oxide may be introduced as described above. It is preferable if metallic nickel particles are thus heated to a temperature of their melting point or higher, and rhenium is diffused into the nickel particles in such a molten state, because this speeds up the diffusion of the rhenium into the particles and also improves production efficiency, and also allows a uniform alloy powder in which rhenium has sufficiently diffused into the interior of the particles to be obtained. The term "metallic nickel particles" as used in the present invention also encompasses particles in this molten state.

Also, a nickel compound that undergoes pyrolysis upon being heated may be used as the nickel raw material, and the precipitation and alloying of the metallic nickel particles may be carried out substantially simultaneously. Examples of thermally decomposable nickel compound powders include nickel hydroxides, nitrates, sulfates, carbonates, oxynitrates, oxysulfates, halides, oxides, ammonium complex and other such inorganic compounds, and carboxylates, resinates, sulfonates, acetylacetonates, and metal monohydric or polyhydric alcoholates, amide compounds, imide compounds, urea compounds, and other such organic compounds, which can be used singly or in combinations of two or more kinds. Hydroxides, carbonates, oxides, carboxylates, resinates, acetylacetonates, alcoholates, and the like nickel compounds are especially preferable because they produce no harmful by-products after pyrolysis.

When a material that produces a reductive atmosphere upon pyrolysis is used as the nickel compound powder, it is possible either to eliminate the reducing agent dispersed in the gas phase, or to reduce the amount thereof. For example, if a carboxylate powder such as nickel acetate is used as the nickel compound powder, and this is pyrolyzed in a nitrogen atmosphere, the decomposition of the carboxylic acid group will generate carbon monoxide and hydrogen, so a reductive atmosphere is obtained.

When a thermally decomposable nickel compound powder is used, just as when metallic nickel particles are used, it is dispersed in a gas phase, and a rhenium oxide vapor is supplied to the gas phase before, during, or after the dispersion of the nickel compound powder. If a nickel compound powder and a rhenium oxide vapor are heated in a uniformly mixed state, the nickel compound powder is pyrolyzed while still in its dispersed state, precipitating solid-state metallic nickel particles or metallic nickel particles that are at least partially molten. After this, the rhenium oxide vapor is reduced, and precipitates metallic rhenium on the surface of the metallic nickel particles in the gas phase so as to be alloyed by further heating.

As described above, the present invention involves manufacturing a nickel-rhenium alloy powder by reducing a rhenium oxide vapor in a gas phase containing this rhenium oxide vapor and metallic nickel particles that are in the solid-state or are at least partially molten, and diffusing the precipitated rhenium into the nickel particles, but many different embodiments are conceivable besides those discussed above. For instance, an atmosphere in which metallic nickel particles are dispersed in a gas phase containing a rhenium oxide vapor can be obtained by producing droplets that contain a rhenium nitric acid solution and a nickel nitrate solution in the gas phase, and heating these droplets, after which a nickel-rhenium alloy powder can be produced by a process that entails the reduction step and alloying step discussed above.

With this process, the alloy powder is not produced by the direct pyrolysis of droplets containing the alloying raw materials, but rather metallic nickel particles and rhenium oxide vapor are first separately produced from droplets containing the alloying raw materials, and then the rhenium oxide is reduced, precipitated, and alloyed. Going through this process clearly differentiates this method from spray pyrolysis methods known in the past. However, the manufacturing apparatus used with conventional spray pyrolysis methods can be used in the above method.

With the above manufacturing method, a nickel-rhenium alloy powder containing the above-mentioned third component can be obtained by having the metallic nickel particles contain the third component, or by having the rhenium oxide vapor be a mixed vapor containing the third component.

(2) Rhenium-containing Alloy Powder Including Rhenium and a Main Component Metal other than Nickel Alloys containing the metals other than nickel as the main component to be alloyed with rhenium can also be manufactured as in the case of the nickel-rhenium alloy discussed above.

Specifically, the main component metal particles to be alloyed with rhenium are dispersed in a gas phase, and a rhenium oxide vapor is supplied to this gas phase either before, during, or after this dispersion. The main component metal particles may be manufactured in advance, or may be produced prior to the above-mentioned dispersion. The main component metal particles may be in the solid-state, but it is preferable if they are at least partially molten by the point when the rhenium is diffused into the main component metal particles.

There are no particular restrictions on the method for manufacturing the main component metal particles, but they are preferably produced by PVD, CVD, the spray pyrolysis method discussed in Patent Document 3 and elsewhere, or the method discussed in Patent Document 6 and elsewhere. The main component metal particles thus produced are preferably moved on continuously to the step described below, along with a carrier gas.

The rhenium oxide is preferably heptavalent rhenium oxide ($Re_2O_7$), and a rhenium nitric acid solution, rhenium chloride solution, or other such precursor may be used.

The rhenium oxide vapor is subjected to a reduction reaction in a state in which the rhenium oxide vapor is uniformly present around the main component metal particles dispersed in the gas phase, rhenium precipitates on the surface of the main component metal particles, and this rhenium diffuses into the particles, so that the main component metal and the rhenium are completely alloyed. The diffusion of the rhenium into the main component metal particles may be accomplished by heating after the rhenium has precipitated on the surface of the particles, or by sufficiently heating the main component metal particles up to that point. The above alloying step is conducted at a high temperature of not lower than 500° C., preferably not lower than 800° C., and more preferably not lower than the melting point of the metal particles. Also, the step of reducing the rhenium and the step of alloying the main component metal with the rhenium do not have to be separated in time, but it is preferable that, while precipitating rhenium, the rhenium precipitated is sequentially alloyed by being diffused into the main component metal particles.

Also, a thermally decomposable main component metal compound powder may be used so that the alloying and the precipitation of the main component metal particles are carried out substantially simultaneously, and a main component metal compound powder material that produces a reductive atmosphere upon pyrolysis may be used here.

Further, an alloy powder containing the above-mentioned third component can also be obtained by using particles containing the third component as the main component metal particles, or by having the rhenium oxide vapor be a mixed vapor containing the third component.

As discussed above, a main component metal-rhenium alloy powder is manufactured by reducing a rhenium oxide vapor in a gas phase containing this rhenium oxide vapor and main component metal particles that are in the solid-state or are at least partially molten, and diffusing the precipitated rhenium into the main component metal particles.

Nickel-rhenium alloy powders will be described below as preferred embodiments of the present invention. With this manufacturing method, nitrogen, argon, or another such inert gas, or a gas that is a mixture of these, is preferably used as a carrier gas to disperse metallic nickel particles or a thermally decomposable nickel compound powder that is a precursor thereof (hereinafter referred to collectively as "nickel raw material particles"). Also, the carrier gas preferably contains a reducing agent such as hydrogen gas that is used in a reduction step, if needed.

A dispersing device is used to disperse the nickel raw material particles in this carrier gas. This dispersing device need not be a special device, and can be any known gas flow type dispersing device, such as an ejector type, Venturi type, orifice type or the like as well as any known jet-mill may be used. In this case, the nickel raw material particles are preferably dispersed in such a low concentration that they will not collide with each other. To this end, the concentration in the carrier gas is no higher than 10 g/L, for example. When using pre-manufactured nickel raw material particles, the nickel raw material particles themselves can sometimes agglomerate, so it is preferable to perform adequate pulverization, crushing, classification, and so forth prior to dispersing the particles in the carrier gas.

When nickel raw material particles produced by a vapor deposition method such as PVD or spray pyrolysis are directly and continuously made into an alloy powder, if the nickel raw material particles produced in the gas phase have been sufficiently dispersed, they may be sent directly to a reaction vessel along with a carrier gas. In this case, there is no need for a dispersing device, but a jet-mill or the like may be used to adjust the particle size in the carrier gas.

Meanwhile, the rhenium oxide vapor is supplied at a suitable timing to the carrier gas. The nickel raw material particles and the rhenium oxide vapor dispersed in/supplied to the carrier gas are sent to the reaction vessel along with the carrier gas while still in their dispersed state. To alloy the particles while still in a low-concentration dispersed state, it is preferable, for example, to use a tubular reaction vessel heated from the outside, supply the nickel raw material particles and the rhenium oxide vapor along with the carrier gas at a constant flow rate from an opening on the raw material introduction side of the reaction vessel, and cause these to pass through the reaction vessel.

When metallic nickel particles are used as the nickel raw material, the state in the reaction vessel is one in which rhenium oxide vapor is uniformly present around the metallic nickel particles. When a thermally decomposable nickel compound powder is used as the nickel raw material, it is pyrolyzed in a heated reaction vessel, metallic nickel particles precipitate, and rhenium oxide vapor is uniformly present around the metallic nickel particles.

Inside the reaction vessel, the rhenium oxide vapor is reduced under heating to precipitate metallic rhenium, which adheres to the surface of the nickel particles. The alloying process will vary with how the temperature is controlled inside the reaction vessel. In the case where the temperature of the metallic nickel particles is low at this point, the process is considered to proceed in such a manner that at least a part of the surface of the nickel particles is covered with metallic rhenium and these rhenium-covered nickel particles are melted by further heating and alloyed. On the other hand, where the nickel particles at this point have already been heated to a temperature close to their melting point, or where the metallic nickel particles at this point have been heated to a temperature of not lower than their melting point and are at least partially molten, the process is considered to proceed in such a manner that metallic rhenium precipitated by reduction adheres to the surface of the metallic nickel particles, and at the same time, it is diffused into the interior of the metallic nickel particles and alloyed. The alloy powder thus produced is then cooled and finally recovered with a bag filter or the like.

The flow rate and passage duration of the mixture of the nickel raw material particles, rhenium oxide vapor, and carrier gas are set as dictated by the apparatus being used, so that the particles will be sufficiently heated to a specific temperature, and preferably at least 800° C., and even more preferably at a temperature of not lower than the melting point of the metallic nickel particles. There are no restrictions on the upper limit to the heating temperature as long as it is not a temperature at which nickel will vaporize, but a higher temperature raises the manufacturing cost. The heating may be performed from the outside of the reaction vessel with an electric furnace, gas furnace, or the like, or a fuel gas may be supplied to the reaction vessel and a combustion flame utilized.

If the temperature to which the nickel particles are heated is not high enough, the metallic rhenium will not diffuse uniformly into the nickel particles, and there may be a gradient to the rhenium concentration from the surface of the particles toward their center, for example. Powder particles having such a concentration gradient are not excluded from being the alloy powder manufactured with the manufacturing method of the present invention, but when a homogeneous alloy powder with no concentration gradient is desired, it is preferable either to heat the nickel particles to a sufficiently high temperature (such as to their melting point or higher), or to control the heating time.

When a powder is manufactured as above, the nickel raw material particles are heated in a state of being highly dispersed in the gas phase, so it is thought that roughly one particle of alloy powder is produced per particle of nickel raw material. Accordingly, the particle size of the alloy powder that is produced is substantially proportional to the particle size of the nickel raw material particles. Therefore, to obtain an alloy powder with an average particle size of 0.05 to 1.0 μm, which is favorable for use in the formation of internal conductors for laminated ceramic electronic parts, it is preferable to use nickel raw material particles with a particle size that is almost the same as the above size in a state of being dispersed in the gas phase. Also, to obtain an alloy powder with an even more uniform particle size, it is preferable to use nickel raw material particles with a uniform particle size. If the nickel raw material particles have a wide particle size distribution, it is preferable to adjust the particle size ahead of time by pulverization, crushing, or classification with a pulverizer or classifier.

A conductor paste containing the nickel-rhenium alloy powder of the present invention is manufactured by uniformly mixing and dispersing with a vehicle component containing a resin binder and a solvent according to a standard method.

There are no particular restrictions on the resin binder, which can be any one that is ordinarily used in conductor pastes, such as ethyl cellulose, hydroxyethyl cellulose, and other such cellulose resins, or acrylic resin, methacrylic resin, butyral resin, epoxy resin, phenol resin, rosin, or the like. There are no particular restrictions on the amount in which the resin binder is added, but it is usually about 1 to 15 weight parts per 100 weight parts conductive powder.

There are no particular restrictions on the solvent as long as it will dissolve the above-mentioned binder resin, but one is suitably selected from among those ordinarily used for conductor pastes and blended. Examples include organic solvents such as alcohols, ethers, esters, hydrocarbons, and the like, water, and solvents that are mixtures of these. There are no restrictions on the amount of solvent as long as it is an amount that is ordinarily used, and the amount is suitably determined according to the properties of the conductive powder, the type of resin, the coating method, and other such factors. Usually, the amount is about 40 to 150 weight parts per 100 weight parts conductive powder.

In addition to the above components, the conductor paste can also arbitrarily contain, according to its intended use, any components that are ordinarily added, such as a ceramic that is the same as, or whose composition is similar to that of, ceramics contained in ceramic green sheets, glass, alumina, silica, zirconia, copper oxide, manganese oxide, titanium oxide, and other such metal oxides, montmorillonite, and other such inorganic powders, as well as metal organic compounds, plasticizers, dispersants, surfactants, and so forth.

A conductor paste is manufactured by uniformly dispersing a conductive powder together with other additives in a vehicle containing a resin binder and a solvent according to an ordinary method. The conductor paste of the present invention is particularly useful as an internal conductor paste for laminated capacitors, laminated PTC elements, and other such laminated ceramic electronic parts, and composite substrates and composite parts in which these are incorporated, but can also be used as other ordinary thick-film conductor pastes.

The above description was of a case of manufacturing a nickel-rhenium alloy powder, which is typical of the present invention, but the same applies to the manufacture of a rhenium-containing alloy powder whose main component metal is something other than nickel. Naturally, though, the heating temperature conditions should be suitably modified according to any differences in the raw materials being used and so forth.

EXAMPLES

The present invention will now be described in more specific terms through examples, but is not limited to or by these examples.

Example 1

Metallic nickel particles (nickel powder) in the solid-state, manufactured by PVD and having an average particle size of 0.2 μm were supplied to a jet-mill at a supply rate of 500 g/hr, and dispersed with nitrogen gas at a flow rate of 200 L/min.

Separately from this, rhenium oxide ($Re_2O_7$) was heated to 300° C. to generate a rhenium oxide vapor, and this was supplied to a gas flow in which the above-mentioned nickel powder had been dispersed, at a rate of approximately 30 g/hr (calculated as rhenium metal), using nitrogen gas at 10 L/min as a carrier. Hydrogen gas was then supplied at 10 L/min into this dispersed gas flow to create a reductive atmosphere, and the particles were introduced into a reaction tube in an electric furnace that had been heated to 1200° C. After passing through the electric furnace, the gas flow was cooled to about 100° C., after which the produced powder was recovered with a bag filter.

The composition of the powder produced above was measured by ICP (Inductively Coupled Plasma spectrometry), which confirmed that the powder contained 6 wt % rhenium. The powder was also analyzed with an X-ray diffractometer, which confirmed that the diffraction peak of nickel had shifted to a slightly lower angle, and no diffraction peak for anything but nickel was confirmed. It was confirmed from the above results that the produced particles were alloy particles containing rhenium in a solid solution state in nickel.

Also, it was confirmed by scanning electron microscope that there was almost no difference in the particle size and shape between the raw material nickel particles and the produced particles, and that the powder had a uniform particle size and good dispersibility.

The sintering behavior of the produced alloy powder was examined by TMA (thermomechanical analysis). The powder was molded into a cylindrical sample with a diameter of 5 mm and a height of approximately 2 mm, and the shrinkage in the height direction of the sample was measured while the sample was heated at a temperature elevation rate of 5° C./min in nitrogen gas containing 4% hydrogen. The shrinkage start temperature and the shrinkage end temperature were found by extrapolation from the resulting TMA chart. As a result, the shrinkage start temperature was 530° C., and the shrinkage end temperature was 730° C.

The oxidation behavior of the powder in air was examined by TG (thermogravimetric analysis). The measurement conditions were such that the powder was heated to 300° C. at a temperature elevation rate of 5° C./min, and held at 300° C. for 2 hours. The oxidation start temperature and the percentage weight increase after the powder was held at 300° C. for 2 hours were measured from the resulting TG chart. As a result, the oxidation start temperature was 290° C., and the weight increase was 0.8%.

Comparative Example 1

The sintering behavior and oxidation behavior were measured in the same manner for when a pure nickel powder was used as the nickel raw material in Example 1, the result of which was that the shrinkage start temperature was 320° C., the shrinkage end temperature was 580° C., the oxidation start temperature was 250° C., and the weight increase was 1.5%.

It was confirmed from a comparison of the results in Example 1 and Comparative Example 1 that with the alloy powder of the present invention (Example 1), the alloying of nickel and rhenium effectively shifted the start of sintering shrinkage of the powder to the higher temperature side, and also increased oxidation resistance.

Example 2

Instead of supplying rhenium oxide ($Re_2O_7$) vapor as in Example 1, a rhenium nitric acid solution was sprayed with nitrogen gas at 10 L/min using a twin-fluid nozzle, and the droplets thus generated were supplied at a rate of approximately 30 g/hr (calculated as rhenium metal) into a gas flow in which a nickel powder had been dispersed. All other conditions were the same as in Example 1.

It was confirmed by scanning electron microscope that the powder thus produced was composed of particles with a uniform average size of 0.2 μm, and had good dispersibility. The composition of the powder thus produced was measured by ICP, which confirmed that it contained 6 wt % rhenium. The powder was also analyzed with an X-ray diffractometer, which confirmed that the diffraction peak of nickel had shifted to a slightly lower angle, and no diffraction peak for anything but nickel was confirmed. It was confirmed from the above results that the produced particles were alloy particles containing rhenium in a solid solution state in nickel.

Example 3

A powder of nickel acetate tetrahydrate was supplied to a jet-mill at a supply rate of 2000 g/hr, and the powder was pulverized and dispersed with nitrogen gas at a flow rate of 200 L/min.

Separately from this, rhenium oxide ($Re_2O_7$) was heated to 300° C. to generate a rhenium oxide vapor, and this was supplied to a gas flow in which nickel acetate powder had been dispersed, at a rate of approximately 50 g/hr (calculated as rhenium metal), using nitrogen gas at 10 L/min as a carrier. This dispersed gas flow was introduced into a reaction tube in an electric furnace that had been heated to 1550° C. After passing through the electric furnace, the gas flow was cooled to about 100° C., after which the produced powder was recovered with a bag filter.

It was confirmed by scanning electron microscope that the powder thus produced was composed of spherical particles with a uniform average size of 0.3 μm, and had good dispersibility. The composition of the powder thus produced was measured by ICP, which confirmed that it contained 10 wt % rhenium. The powder was also analyzed with an X-ray diffractometer, which confirmed that the diffraction peak of nickel had shifted to a slightly lower angle, and no diffraction peak for anything but nickel was confirmed. It was confirmed from the above results that the produced particles were alloy particles containing rhenium in a solid solution state in nickel.

Example 4

A powder was manufactured in the same manner as in Example 3, except that the supply rate of the rhenium oxide ($Re_2O_7$) was changed to approximately 5 g/hr (calculated as rhenium metal).

It was confirmed by scanning electron microscope that the powder thus produced was composed of spherical particles with a uniform average size of 0.3 μm, and had good dispersibility. The composition of the powder thus produced was measured by ICP, which confirmed that it contained 1 wt % rhenium. The powder was also analyzed with an X-ray diffractometer, which confirmed that the diffraction peak of nickel had shifted to a slightly lower angle, and no diffraction peak for anything but nickel was confirmed. It was confirmed from the above results that the produced particles were alloy particles containing rhenium in a solid solution state in nickel.

Example 5

Metallic nickel was heated and vaporized with a high-temperature gas in a plasma state and at a temperature of approximately 10,000° C., and the vapor thus generated was sent to a tubular cooler using a 4% hydrogen-nitrogen mixed gas at 100 L/min as a carrier, which produced metallic nickel particles.

Separately from this, rhenium oxide ($Re_2O_7$) was heated to 300° C. to generate a rhenium oxide vapor, and this was sent to the cooler, using nitrogen gas at 5 L/min as a carrier. The temperature inside the cooler in the portion to which the rhenium oxide vapor was sent was 1700° C. After this the gas was cooled to about 100° C., and a powder was recovered with a bag filter.

It was confirmed by scanning electron microscope that the powder thus produced was composed of spherical particles with a uniform average size of 0.08 μM and had a good dispersibility. The composition of the powder thus produced was measured by ICP, which confirmed that it contained 5 wt% rhenium. The powder was also analyzed with an X-ray diffractometer, which confirmed that the diffraction peak of nickel had shifted to a slightly lower angle, and no diffraction peak for anything but nickel was confirmed. It was confirmed from the above results that the produced particles were alloy particles containing rhenium in a solid solution state in nickel.

Example 6

Using a reaction apparatus in which three electric furnaces were arranged in series and designed to allow a reaction tube to be heated, nitrogen gas was allowed to flow from one end of the reaction tube at a rate of 10 L/min. Anhydrous nickel chloride that had been placed in a porcelain crucible was positioned at the portion of the electric furnaces farthest upstream, where the temperature had been set to 600° C., and a nickel chloride vapor was generated. This vapor was sent along with nitrogen gas to the second stage electric furnace on the downstream side, which had been heated to 1100° C. Hydrogen gas was supplied at a rate of 5 L/min to the inlet of the second stage electric furnace, where it was mixed with nitrogen gas containing the nickel chloride vapor, and the nickel chloride was reduced to produce metallic nickel particles.

Separately from this, rhenium oxide ($Re_2O_7$) was heated to 300° C. to generate a rhenium oxide vapor, and this was sent to the outlet portion of the second stage electric furnace, using nitrogen gas as a carrier at 1 L/min. This was sent along with the produced nickel particles to the third stage electric furnace, which had been heated to 1000° C. The rhenium oxide vapor was reduced by an excess of hydrogen supplied in order to reduce the nickel chloride vapor, and metallic rhenium was precipitated on the surface of the nickel particles and alloyed. The particles that came out of the heated section were cooled to about 100° C., and then recovered in a trap filter.

It was confirmed by scanning electron microscope that the powder thus produced was composed of spherical particles with a uniform average size of 0.2 μm, and had good dispersibility. The composition of the powder thus produced was measured by ICP, which confirmed that it contained 7 wt % rhenium. The powder was also analyzed with an X-ray diffractometer, which confirmed that the diffraction peak of nickel had shifted to a slightly lower angle, and no diffraction peak for anything but nickel was confirmed. It was confirmed from the above results that the produced particles were alloy particles containing rhenium in a solid solution state in nickel.

Example 7

Nickel nitrate hexahydrate was dissolved in water, and a rhenium nitric acid solution was added to prepare an aqueous solution with a nickel concentration of 45 g/L and a rhenium concentration of 5 g/L. A raw material solution was obtained by adding, as a reducing agent, ethylene glycol in an amount of 100 mL per liter to this aqueous solution. This raw material solution was made into a mist with an ultrasonic atomizer, and this mist was sent to a ceramic reaction tube that had been heated to 1550° C. by an electric furnace, using nitrogen gas at 10 L/min as a carrier. This heating vaporized the water and pyrolyzed the raw material compounds, producing an oxide, and the rhenium oxide component volatilized into a vapor. Next, the reductive gas generated by the decomposition of the ethylene glycol turned the nickel oxide particles into metallic nickel particles, and the rhenium oxide vapor precipitated as metallic rhenium on the surface of the metallic nickel particles. The precipitated rhenium diffused into the nickel particles and alloyed with them, and the alloyed particles were heated to a temperature of not lower than their melting point to produce spherical particles. The particles thus produced were cooled to about 100° C., and then recovered in a trap filter.

It was confirmed by scanning electron microscope that the powder thus produced was composed of spherical particles with a uniform average size of 0.5 μm, and had good dispersibility. The composition of the powder thus produced was measured by ICP, which confirmed that it contained 10 wt % rhenium. The powder was also analyzed with an X-ray diffractometer, which confirmed that the diffraction peak of nickel had shifted to a slightly lower angle, and no diffraction peak for anything but nickel was confirmed. It was confirmed from the above results that the produced particles were alloy particles containing rhenium in a solid solution state in nickel.

Example 8

A rhenium nitric acid solution was added to a nitric acid aqueous solution of a dinitrodiammine platinum complex to prepare an aqueous solution with a platinum concentration of 27 g/L and a rhenium concentration of 3 g/L. A raw material solution was obtained by adding, as a reducing agent, ethylene glycol in an amount of 100 mL per liter to this aqueous solution. This raw material solution was made into a mist with an ultrasonic atomizer, and this mist was sent to a carbon reaction tube that had been heated to 1900° C. by an electric furnace equipped with a carbon heater, using nitrogen gas at 10 L/min as a carrier. This heating vaporized the water and pyrolyzed the raw material compounds, producing rhenium oxide, which volatilized into a vapor. Meanwhile, the metallic platinum particles generated by the pyrolysis of the raw material compound were heated to a temperature of not lower than their melting point, thereby at least partially melting, on the surface of which rhenium oxide vapor was precipitated as metallic rhenium. The precipitated rhenium diffused into the platinum particles and alloyed with them, producing spherical particles. After passing through the heated portion of the carbon reaction furnace, the particles were cooled in the reaction tube to a temperature of 300 to 400° C., then mixed with an air flowing at a flow rate of about 1000 L/min, then rapidly cooled to 100° C. or lower, and finally recovered in a trap filter.

It was confirmed by scanning electron microscope that the powder thus produced was composed of spherical particles with a uniform average size of 0.4 μm, and had good dispersibility. The composition of the powder thus produced was measured by ICP, which confirmed that it contained 10 wt % rhenium. The powder was also analyzed with an X-ray diffractometer, which confirmed only a diffraction peak corresponding to platinum, and this confirmed that the produced particles were alloy particles containing rhenium in a solid solution state in platinum.

Example 9

A rhenium nitric acid solution was added to a palladium nitrate aqueous solution to prepare an aqueous solution with a palladium concentration of 95 g/L and a rhenium concentration of 5 g/L. A raw material solution was obtained by adding, as a reducing agent, ethylene glycol in an amount of 100 mL per liter to this aqueous solution. This raw material solution was made into a mist with an ultrasonic atomizer, and this mist was sent to a ceramic reaction tube that had been heated to 1600° C. by an electric furnace, using nitrogen gas at 10 L/min as a carrier. This heating vaporized the water and pyrolyzed the raw material compounds, producing rhenium oxide, which volatilized into a vapor. Meanwhile, the metallic palladium particles generated by the pyrolysis of the raw material compound were heated to a temperature of not lower than their melting point, thereby at least partially melting, on the surface of which rhenium oxide vapor was precipitated as metallic rhenium. The precipitated rhenium diffused into the palladium particles and alloyed with them, producing spherical particles. After passing through the heated portion of the electric furnace, the particles were cooled in the reaction tube to a temperature of 300 to 400° C., then mixed with an air flowing at about 1000 L/min, then rapidly cooled to 100° C. or lower, and finally recovered in a trap filter.

It was confirmed by scanning electron microscope that the powder thus produced was composed of spherical particles with a uniform average size of 0.6 μm, and had good dispersibility. The composition of the powder thus produced was measured by ICP, which confirmed that it contained 5 wt % rhenium. The powder was also analyzed with an X-ray diffractometer, which confirmed only a diffraction peak corresponding to palladium, and this confirmed that the produced particles were alloy particles containing rhenium in a solid solution state in palladium.

Example 10

Spherical metallic iron particles with an average size of 3.5 μm and manufactured by the carbonyl method were supplied to a jet-mill at a supply rate of 100 g/hr and dispersed with nitrogen gas flowing at a flow rate of 200 L/min.

Separately from this, rhenium oxide ($Re_2O_7$) was heated to 300° C. to generate a rhenium oxide vapor, and this was supplied to a gas flow in which the above-mentioned iron powder had been dispersed, at a rate of approximately 5 g/hr (calculated as rhenium metal), using nitrogen gas at 10 L/min as a carrier. Hydrogen gas was then supplied at 10 L/min into this dispersed gas flow to create a reductive atmosphere, and the particles were introduced into a reaction tube in an electric furnace that had been heated to 1600° C. After passing through the electric furnace, the gas flow was cooled to about 100° C., after which the produced powder was recovered with a bag filter.

The composition of the powder produced above was measured by ICP, which confirmed that the powder contained 5 wt % rhenium. The powder was also analyzed with an X-ray diffractometer, which confirmed only a diffraction peak corresponding to iron, and this confirmed that the produced particles were alloy particles containing rhenium in a solid solution state in iron.

What is claimed is:

1. A method for manufacturing a rhenium-containing alloy powder, containing rhenium and a metal that includes at least one metal selected from the group consisting of nickel, platinum, palladium, iron, cobalt, ruthenium, and rhodium, that alloys with rhenium, comprising the steps of:

dispersing particles of the metal in a gas phase and causing a vapor of rhenium oxide to be present around the particles;

reducing the rhenium oxide; and diffusing the rhenium precipitated on a surface of the metal particles by the reduction, into the metal particles under a high temperature to form a rhenium-containing alloy powder having a rhenium content of from 0.01 to 50 wt. %.

2. The manufacturing method according to claim 1, wherein, in the step of diffusing the rhenium into the metal particles, the metal particles are at least partially molten.

3. The manufacturing method according to claim 1, wherein at least the step of producing the rhenium-containing alloy powder is conducted in a non-oxidizing atmosphere.

4. The manufacturing method according to claim 1, wherein a step of producing the metal particles is conducted prior to the step of dispersing the metal particles.

5. The manufacturing method according to claim 4, wherein the metal particles are produced by a manufacturing method selected from the group consisting of physical vapor deposition, chemical vapor deposition, spray pyrolysis and a method in which a thermally decomposable metal compound powder is pyrolyzed in a gas phase.

6. The manufacturing method according to claim 1, wherein a raw material solution obtained by dissolving the metal and rhenium is made into droplets and then heated, to thereby disperse the metal particles in the gas phase and cause rhenium oxide vapor to be present around the particles.

7. The manufacturing method according to claim 1, wherein an average particle size of the rhenium-containing alloy powder is from 0.01 to 10 μm.

8. The manufacturing method according to claim 1, wherein the metal includes nickel.

9. The manufacturing method according to claim 1, wherein the metal includes at least one metal selected from the group consisting of nickel, platinum, palladium and iron.

* * * * *